US009670556B2

(12) United States Patent
Pedersen

(10) Patent No.: US 9,670,556 B2
(45) Date of Patent: Jun. 6, 2017

(54) APPARATUS FOR PROCESSING THE SKIN SIDE OF A FUR

(71) Applicant: Jasopels A/S, Bording (DK)

(72) Inventor: Kurt Pedersen, Vinderup (DK)

(73) Assignee: EIKON TECHNOLOGIES HOLDING S.À.R.L., Luxembourg (LU)

( * ) Notice: Subject to any disclaimer, the term of this patent is extended or adjusted under 35 U.S.C. 154(b) by 304 days.

(21) Appl. No.: 14/388,531

(22) PCT Filed: Mar. 20, 2013

(86) PCT No.: PCT/EP2013/055831
§ 371 (c)(1),
(2) Date: Sep. 26, 2014

(87) PCT Pub. No.: WO2013/143945
PCT Pub. Date: Oct. 3, 2013

(65) Prior Publication Data

US 2015/0114049 A1 Apr. 30, 2015

(30) Foreign Application Priority Data

Mar. 28, 2012 (DK) ..... 2012 00228

(51) Int. Cl.
*C14B 1/10* (2006.01)
*C14B 1/02* (2006.01)
(Continued)

(52) U.S. Cl.
CPC ..... *C14B 1/10* (2013.01); *C14B 1/02* (2013.01); *C14B 15/00* (2013.01); *C14B 17/00* (2013.01); *C14B 17/02* (2013.01)

(58) Field of Classification Search
CPC .. C14B 1/02; C14B 1/10; C14B 15/00; C14B 17/02
See application file for complete search history.

(56) References Cited

U.S. PATENT DOCUMENTS 3,048,995 A * 8/1962 Browning ..... C14B 1/02 69/46
3,049,906 A * 8/1962 Mills ..... C14B 1/02 69/46
(Continued)

FOREIGN PATENT DOCUMENTS

CN 87100184 A 1/1987
DK 20060182 U3 7/2006
(Continued)

OTHER PUBLICATIONS

International Search Report for corresponding application PCT/EP2013/055831 filed Mar. 20, 2013; Mail date Jun. 24, 2013.

*Primary Examiner* — Shaun R Hurley
(74) *Attorney, Agent, or Firm* — Cantor Colburn LLP

(57) ABSTRACT

An apparatus for processing the skin side of a tubular fur where one or more scraping means are configured for being arranged in a first position away from a mandrel of the apparatus with a first distance in relation to the center axis of the mandrel, and in a third position where the scraping means are configured for being in contact with the skin side so as to process the skin side of the fur, where the one or more scraping means are furthermore configured for being arranged in a second predefined position being arranged between the first position and the third second position with a second predefined distance in relation to the centre axis of the mandrel, and the apparatus is configured for automatically releasing the scraping means from the second position towards the third position when predetermined criteria is complied with.

19 Claims, 8 Drawing Sheets

(51) Int. Cl.

| | |
|---|---|
| ***C14B 15/00*** | (2006.01) |
| ***C14B 17/00*** | (2006.01) |
| ***C14B 17/02*** | (2006.01) |

(56) References Cited

U.S. PATENT DOCUMENTS

| | | | | | |
|---|---|---|---|---|---|
| 3,081,615 | A | * | 3/1963 | Thelen | C14B 1/02 69/46 |
| 3,744,279 | A | * | 7/1973 | Pavlov | C14B 1/10 69/46 |
| 4,314,465 | A | | 2/1982 | Reid | |
| 4,428,210 | A | * | 1/1984 | Kraushaar | C14B 1/02 69/46 |
| 4,745,782 | A | | 5/1988 | Larsen | |
| 4,787,221 | A | | 11/1988 | Johansson | |
| 2013/0139560 | A1 | * | 6/2013 | Pedersen | C14B 1/02 69/44 |

FOREIGN PATENT DOCUMENTS

| | | | |
|---|---|---|---|
| DK | 201100055 | U3 | 5/2011 |
| EP | 2093299 | A1 | 8/2009 |
| FR | 2579225 | A1 | 9/1986 |
| WO | 2012019606 | A1 | 2/2012 |

* cited by examiner

D1
CA
POS1
30
4a
30
2
LD
2a
2a
MD

4a
D2
CA
DIST1
POS2
30
30
P1
2
2a
2a
3a
LD
MD

CA
POS3
P1
30
2a
30
2a
LD
MD

APPARATUS FOR PROCESSING THE SKIN SIDE OF A FUR

TECHNICAL FIELD

The invention relates to an apparatus for processing the skin side of a tubular fur, and a method of operating scraping means.

BACKGROUND

A skin taken from a furred animal such as a mink normally has a layer or residues of fat, tendons and/or flesh that is firmly attached to the skin side of the fur. Before the fur can be used for further processing, such layers or residues must be removed from the skin side.

For that purpose, different apparatuses for scraping the skin side of a fur are known. Such apparatuses comprise a mandrel on which a tubular fur can be arranged with the skin side facing outwards, and one or more scraping units comprising scraping means such as scraping rollers where each scraping roller comprise scraping edges. By rotating the scraping rollers around each their rotation axis when in contact with the skin side of the fur on the mandrel, while the scraping units and the mandrel are moved relative to each other in the longitudinal direction of the mandrel, the above mentioned restudies can be removed from the skin side of the fur.

However, the scraping edges of such scraping rollers are over time worn down and needs to be exchanged with new/fresh scraping rollers. This may be a time consuming and troublesome process that may result in the apparatus being out of operation for a considerably amount of time.

The disclosure provides a solution that may reduce or even avoid the above drawback(s).

BRIEF SUMMARY

The invention relates to an apparatus for processing the skin side of a tubular fur, which apparatus comprises:

a tapering mandrel comprising a first part that is thinner than a second part of the mandrel, on which mandrel the tubular fur can be drawn from the first part of the mandrel towards the second part of the mandrel so that the skin side of the fur faces outwards and the fur side of the fur faces inwards towards the mandrel, and one or more scraping units, each scraping unit comprising one or more scraping means for scraping said skin side, said one or more scraping units being configured for being moved towards and away from said mandrel during operation of said apparatus, said apparatus being configured for facilitating a movement between said mandrel and said one or more scraping means in the longitudinal direction of said mandrel during operation, wherein said one or more scraping means are configured for being arranged in a first position away from said mandrel with a first distance in relation to the center axis of said mandrel, and in a third position where the scraping means are configured for being in contact with said skin side so as to process the skin side of said fur, wherein said one or more scraping means are furthermore configured for being arranged in a second predefined position, said second position being arranged between said first position and said third second position with a second predefined distance in relation to the center axis of said mandrel, and wherein said apparatus is configured for automatically releasing said scraping means from said second position towards said third position when predetermined criteria is complied with.

The apparatus may be designed for operating with scraping means such as e.g. scraping rollers with various diameters. For example, when scraping edges of a scraping roller are worn down, the scraping roller needs to be exchanged with a new/fresh scraping roller to ensure an adequate scraping of the skin side. The scraping rollers with worn scraping edges are however not necessarily discarded. Instead, the edges of the worn scraping rollers may be sharpened and may thus be reused in an apparatus afterwards. This sharpening of the edges however reduces the diameter of the scraping roller. Hence, scraping means of different sizes may be used in the same apparatus.

Preferably, the scraping rollers are arranged to get in contact with the skin side at a predefined area if the skin side of the fur such as e.g. at/near the neck region of the fur. However, e.g. due to the tapering configuration of the mandrel, if the scraping roller(s) are arranged to engage with the skin to late, e.g. if an exchange to a scraper roller with a smaller diameter than the previous scraper roller is made, a part of the front of the fur may not be scraped adequately. Also if the scraping roller(s) are arranged to engage with the skin to soon, which may happen if an exchange to a scraping roller with a larger diameter than the previous scraping roller is made, the scraping rollers may harm the front part of the fur.

Thus, the individual scraping unit may need to be calibrated, e.g. manually after an exchange of a scraping roller so that the scraping roller(s) engage with the skin at the correct position on the mandrel.

However, by the present invention, the need of calibration may be reduced or even omitted. The reason for this is that the scraping means are kept in the second position between the first and the third position, and when the mandrel (and/or the scraping means) is/are moved in the longitudinal direction of the mandrel, the scraping means can be released quickly towards the mandrel when the predetermined criteria are complied with. This may result in that a calibration of the scraping units may be avoided in that the second position preferably is arranged so that a distance/gap between the scraping edges of the scraping means and the region of the fur where the scraping means are intended/wished to start the scraping of the fur is established. This distance/gap results in that scraping means of various sizes and/or types may be utilized without the need of calibrating/adjusting the apparatus after exchange of scraping means, since the scraping means are moved to get in contact with the skin side on the mandrel when the criteria is/are complied with.

The third position may e.g. be defined by the surface of the mandrel. Hereby is meant that the scraping means may be arranged to scrape the skin covering the surface of the mandrel in the third position. Since the mandrel may comprise inclining surfaces that inclines from the front end of the mandrel towards the thicker part of the mandrel, the third position may be dependent on the position of the scraping means relative to the mandrel during scraping of the skin side of the fur.

The said distances may e.g. be measured between a rotation axis of a scraper means and the center axis of the mandrel. However, alternatively, the measurements may be performed from e.g. any suitable part of the scraper unit that is arranged for being moved towards and away from said mandrel, and e.g. the center axis of the mandrel.

In aspects of the invention, the distance from the scraping means to the center axis of the mandrel in said first position may be larger than the distance from the scraping means to the center axis in the second position.

In an aspect of the invention said predetermined criteria may comprise that the apparatus is configured for detecting the position of the mandrel in relation to said scraping means during said movement in the longitudinal direction, and wherein said apparatus is configured for releasing said one or more scraping means from the second position towards the mandrel when the mandrel and/or said one or more scraping means is/are in a predetermined position during said movement.

For example, in an aspect of the invention, the said predetermined criteria may comprises that the apparatus is configured for detecting the position of the mandrel when the mandrel is moved in its longitudinal direction, and wherein the apparatus is configured for releasing the said one or more scraping means from the second position when the mandrel is in a predetermined position in relation to the scraping means during movement of the mandrel in its longitudinal direction. This aspect may e.g. be relevant in aspects where the scraping units are not moved in the longitudinal direction of the mandrel, and where the mandrel is moved in its longitudinal direction.

However, it is understood that the predetermined criteria may comprise detecting any suitable parameter that may help to determine when to release said scraping means towards the third position from the second position, e.g. by means of a timer arrangement, a mechanical triggering arrangement and/or any other suitable means.

Hence, e.g. due to the reduced distance between the scraping edges of the scraping means in the second position, and due to the detection of the movement of the mandrel, the scraping means may be released from the second position and get in contact with the skin side at the desired area of the fur. Preferably, the scraping of the fur is started in and/or substantially at/near/behind the neck region of the fur.

In an advantageous aspect of the invention, the scraping means may be configured for being released from said second position towards said third position when said one or more scraping means are opposite to a predetermined position on said mandrel. The said predetermined position may e.g. be where the neck region of the fur is located. However it may also in aspects of the invention be a position that is located before the neck region on the skin so that the scraping means are opposite to this position before the neck region. Hence, e.g. a possible time delay from releasing the scraping means until they are in contact with the mandrel/skin side may be compensated for.

In aspects of the invention, release of said scraping means from said second position to said third position may be configured to be dependent on the speed of propulsion of said mandrel so that said scraping means are released from said second position to said third position when the mandrel is in different positions in relation to the scraping means dependent on the speed of propulsion of said mandrel.

In aspects of the invention, the mandrel may be driven in its longitudinal direction with different predetermined speeds, e.g. dependent on the type of skin, the scraping pressure acting on the skin side, dependent on the race of the furred animal from which the skin originates and/or the like. The speed of the mandrel may in such aspects e.g. be dependent on different settings in a computer program configured for controlling the propulsion speed of the mandrel. In such aspects, a computer program may be adapted to control the release of the scraping means from the second position towards the third position dependent on the speed of propulsion of the mandrel. If for example the mandrel is driven with a high speed, the scraping means should be released from the second position towards the mandrel earlier compared to if the mandrel was driven with a lower speed so as to compensate for the time delay from releasing the scraping means until they are in contact with the mandrel/skin side. So hence, the time for releasing the mandrel from the second position may be arranged to vary automatically dependent of the speed of propulsion of the mandrel. This may e.g. facilitate that the scraping means gets in contact with a skin on the mandrel at substantially the same location no matter the speed of the mandrel.

In preferred aspects, the second position may be located so that the scraping edges of said at least one scraping means facing the skin side during rotation are arranged between the center axis of the mandrel and a plane defined by a part of the surface of said mandrel and being substantially parallel to said center axis of said mandrel. Hence, the scraping means may be located especially close to the surface of the mandrel so that e.g. a time delay from releasing the scraping means and until the scraping edges gets in contact with the intended part of the skin side of the fur may be reduced.

The second position may hence in aspects of the invention be arranged so that if the scraping means was maintained in the second position, the scraping means would engage the skin side at a location further down the mandrel compared to if the scraping means was arranged in the third position.

In an advantageous aspect of the invention, said scraping means may be arranged to be retained in said second position by means of a stop arrangement, and said apparatus may be configured for automatically triggering said stop arrangement when said predetermined criteria is complied with so as to allow movement of said scraping means from said second position towards said mandrel to said third position.

Advantageously, said apparatus may in aspects of the invention comprise a stop part being configured for being moved between a first stop part position where it is arranged for retaining said at least one scraper means in said second position, and a second stop part position where the said one or more scraping means are allowed to pass from said second position to said third position.

Thus, an advantageous and reliable control of the movement from the second to the third position may be achieved.

The scraping means may e.g. be arranged for being moved to said first position when the skin side has been scraped. Hence, the stop part may be arranged in the first stop part position while the scraping means are in the first position, and the scraping means may be arranged in the second position when the stop part is/has been arranged in the first stop part position.

In an aspect of the invention, said movement between said mandrel and said scraping means in the longitudinal direction of said mandrel may comprise different predefined speeds in the longitudinal direction of said mandrel, said predefined speeds comprising a first speed and a second predefined speed, said second predefined speed being higher than said first predefined speed.

Thus, e.g. a time delay from the releasing of the scraping means and until the scraping means engages with the skin side may be compensated for, e.g. automatically.

In aspects, the mandrel and/or the scraping means may be arranged for being moved with said first speed in the longitudinal direction of the mandrel at least until said scraping means is in contact with said skin side, and wherein said mandrel and/or said scraping means are arranged for being moved with said second speed when said scraping means are in contact with said skin side.

The first speed may e.g. be remained until parts of the fur that has covered the front legs of the animal have been scraped. Then a shift to the second speed may be performed. Alternatively, a shift to the second speed may be performed substantially after the scraping means gets in contact with the skin side and/or the like.

In a preferred aspect of the invention, the said movement between said mandrel and said scraping means in the longitudinal direction of said mandrel comprises that said mandrel is configured for being moved in its longitudinal direction. In such aspects, the scraping units may be kept in a fixed position in relation to the longitudinal direction of the mandrel.

In a further preferred aspect of the invention, said apparatus may comprise at least one set of scraping units comprising scraping means arranged on opposite sides of said mandrel.

In an advantageous aspect of the invention, said scraping means arranged on opposite sides of said mandrel may be arranged for being released from said second position to said third position by means of the same stop arrangement.

In aspects, the said apparatus may comprise a damper arrangement arranged for damping the movement of said at least one scraping means towards and/or away from the mandrel during scraping of the skin surface by means of the at least one scrapping means.

Such a damper arrangement may help to facilitate that the scraping means gets in contact with the skin side in a proper way. For example, when the scraping means are forced from the first to the second position, the scraping means may help to reduce unintentional impacts on the scraping means and/or the skin side when the scraping edges gets in contact with the skin side of the fur while the mandrel and/or the scraping means are moved in the longitudinal direction of the mandrel.

The invention furthermore relates to a method of operating scraping means of an apparatus for processing fur, wherein said one or more scraping means are arranged:

- in a first position away from a mandrel of said apparatus with a first distance in relation to the center axis of said mandrel
- a third position where the scraping means are arranged to be in contact with said skin side so as to process the skin side of said fur, and
- a second position, said second position being arranged between said first position and said third second position with a second predefined distance in relation to the center axis of said mandrel,
- wherein said scraping means are moved from said second position towards said mandrel to said third position when predetermined criteria are complied with.

In aspects of the method, said mandrel is driven with different speeds, wherein a release of said scraping means from said second position to said third position is dependent on the speed of propulsion of said mandrel so that said scraping means are released from said second position to said third position when the mandrel is in different positions in relation to the scraping means dependent on the speed of propulsion of said mandrel.

This may e.g. provide a more reliable and precise contact with the skin side at the intended location no matter the speed of propulsion of the mandrel Moreover, the invention relates to a computer program product which, when implemented on control means for an apparatus for processing fur, is configured for operating said apparatus.

BRIEF DESCRIPTION OF THE FIGURES

Aspects of the present disclosure will be described in the following with reference to the figures in which.

DETAILED DESCRIPTION

Figure 1:
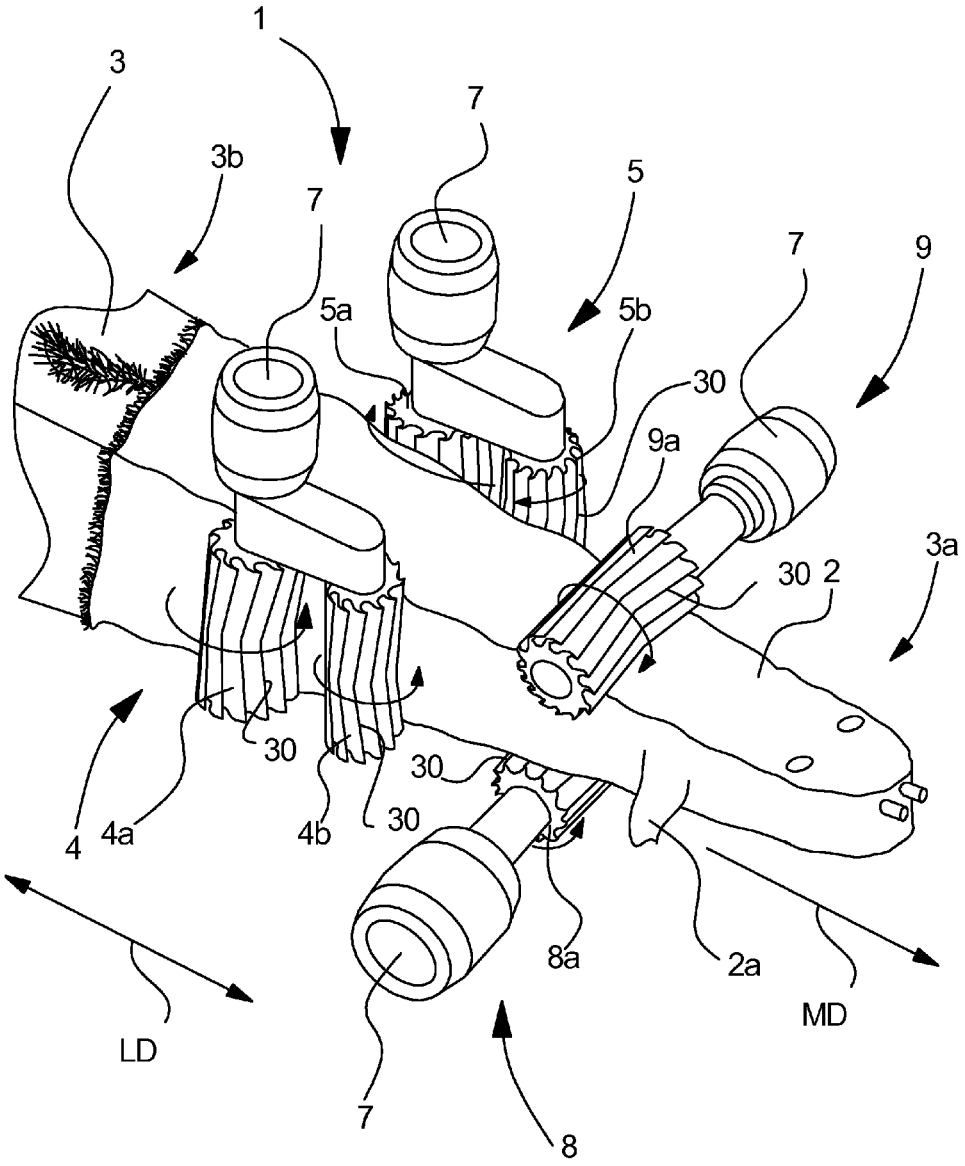
FIG. 1: illustrates an embodiment of an apparatus for processing a tubular fur

FIG. 1 illustrates an embodiment of an apparatus 1 in accordance with the invention for processing the skin side of a tubular fur 2, preferably a mink fur. The tubular fur 2 comprises a fur side and a skin side. The fur comprises different skin parts that originally, before the fur was removed from the furred animal, enclosed different parts of the body of the furred animal. For example skin parts 2*a* that enclosed the legs of the furred animal.

The fur is placed on a mandrel 3 with a first part 3*a* that is thinner than a second part 3*b* of the mandrel 3. The mandrel thus creates/forms a mandrel 3 with a tapered end, where the fur 2 can be drawn on the mandrel from the thin part 3*a* of the mandrel 3.

The apparatus 1 may also comprise one, two or more scraper units 4, 5 8, 9. Each scraper unit 4, 5, 8, 9 comprises, as shown, one or more scraping means 4*a*, 4*b*, 5*a*, 5*b*, 8*a*, 9*a* in the form of e.g. scraping rollers 4*a*, 4*b*, 5*a*, 5*b*, 8*a*, 9*a* designed to rotate to apply a force to the skin side of the fur from opposite sides of the mandrel 3 in a direction towards the second part 3*b* of the mandrel, i.e. the thicker part of the mandrel. The first scraping unit 4 thus comprises a first scraper roller 4*a* and a second scraping roller 4*b*, and the second scraper unit 5 comprises a first scraper roller 5*a* and a second scraper roller 5*b*. The first and second scraper units 4, 5 thus forms a set of scraper units with scraping means arranged to scrape the skin side on opposite sides of the mandrel 3.

The scraping rollers of a scraping unit 4, 5 may, as indicated with arrows, be arranged to rotate in the same direction of rotation. This means that the scraper rollers 4*a*, 4*b* in the first scraper unit 4 are arranged to rotate in the same direction of rotation and the scraper rollers 5*a*, 5*b* in the second scraper unit 5 are arranged to rotate in the same direction of rotation. As shown, the scraper rollers 4*a*, 4*b* rotate in the same direction of rotation during operation but in a direction of rotation that is the opposite direction of rotation to that of the scraper rollers 5*a*, 5*b*. As can be seen, the scraper rollers 4*a*, 4*b*, 5*a*, 5*b* rotate around center axes (not shown) of the scraper rollers that are essentially parallel. In other embodiments, the scraper rollers in a scraper unit 4, 5 may be arranged at an angle to each other (not shown).

The mandrel 3 and the scraper units 4, 5 are arranged to be moved in relation to each other in the longitudinal direction LD of the mandrel. This is preferably achieved by the mandrel 3 being moved towards the tapered end of the mandrel 3, while the scraper units 4, 5 are not moved in the longitudinal direction LD of the mandrel 3. Alternatively, the mandrel 3 may be fixed and the scraper units could thus be moved along the mandrel 3. Also, both the mandrel 3 and the scraper units 4*a*, 4*b* could be moved in relation to each other in embodiments of the invention.

In embodiments in which the mandrel 3 is moved in a direction towards the tapered end of the mandrel 3, the scraper rollers 4*a*, 4*b*, 5*a*, 5*b* will apply a force against the movement direction MD of the mandrel, against the thicker, second part of the mandrel 3*b*.

The scraper units 4, 5 are arranged so that the scraping means 4*a*, 4*b* 5*a*, 5*b* are arranged to be movable towards and away from the mandrel 3 e.g. in order to be able to apply a controlled contract pressure against the skin side of the fur on the mandrel. This may, for example, be controlled via one or more pressure arrangements (not illustrated), comprising, for example, linear actuators such as pneumatic cylinders, a hydraulics system, a spindle and/or any other suitable means.

Also, in FIG. 1, the scraping units are illustrated to comprise two scraping means 4*a*, 5*a*, 4*b*, 5*b* each. However, in embodiments of the invention, the first scraping unit 4 and the second scraping unit 5 may comprise only one scraping means such as e.g. the scraping rollers 4*a*, 5*a*. See e.g. FIG. 3. Also, the scraping units may in other embodiments comprise two scraping means as illustrated or even more scraping means. Also, even though the scraping units 8, 9 are only illustrated comprising one scraping means each, the scraping units 8, 9 may also each comprise two or more scraping means in embodiments of the invention.

In the present example, the scraping units 4, 5 are arranged for scraping the skin side of the fur 2 arranged on the oppositely arranged side surfaces of the mandrel. The third and fourth scraping units 8, 9 are arranged for scraping the skin arranged on side surfaces comprising top and bottom surfaces of the mandrel arranged opposite to each other.

As indicated, the scraping means may be rotated around their intended rotation axis by means of drive means 7 in the form of e.g. an electric motor. However, it is understood that any suitable drive means for rotating the scraping means around their intended rotation axis may be utilized in embodiments of the invention.

In FIG. 1, the scraping means 4*a*, 4*b* of the first scraping unit 4 may be rotated by the same drive means 7 of the first scraping unit 4 and may be connected by a chain drive, a belt, a toothed wheel arrangement and/or the like. Likewise the scraping means 5*a*, 5*b* of the second scraping unit 5 may be rotated by the same drive means 7 of the second drive unit and may be connected by a chain drive, a belt, a toothed wheel arrangement and/or the like.

Each of the scraping means preferably comprises a plurality of scraping edges 30 for scraping the skin side of the fur when in contact with the skin side. The scraping edges 30 may e.g. be arranged to be V-shaped and may form the circumference of the scraping means as illustrated. However, it is understood that the scraping edges may be arranged and/or formed in any suitable way in other aspects of the invention.

Figures 2A, 2B, 2C:
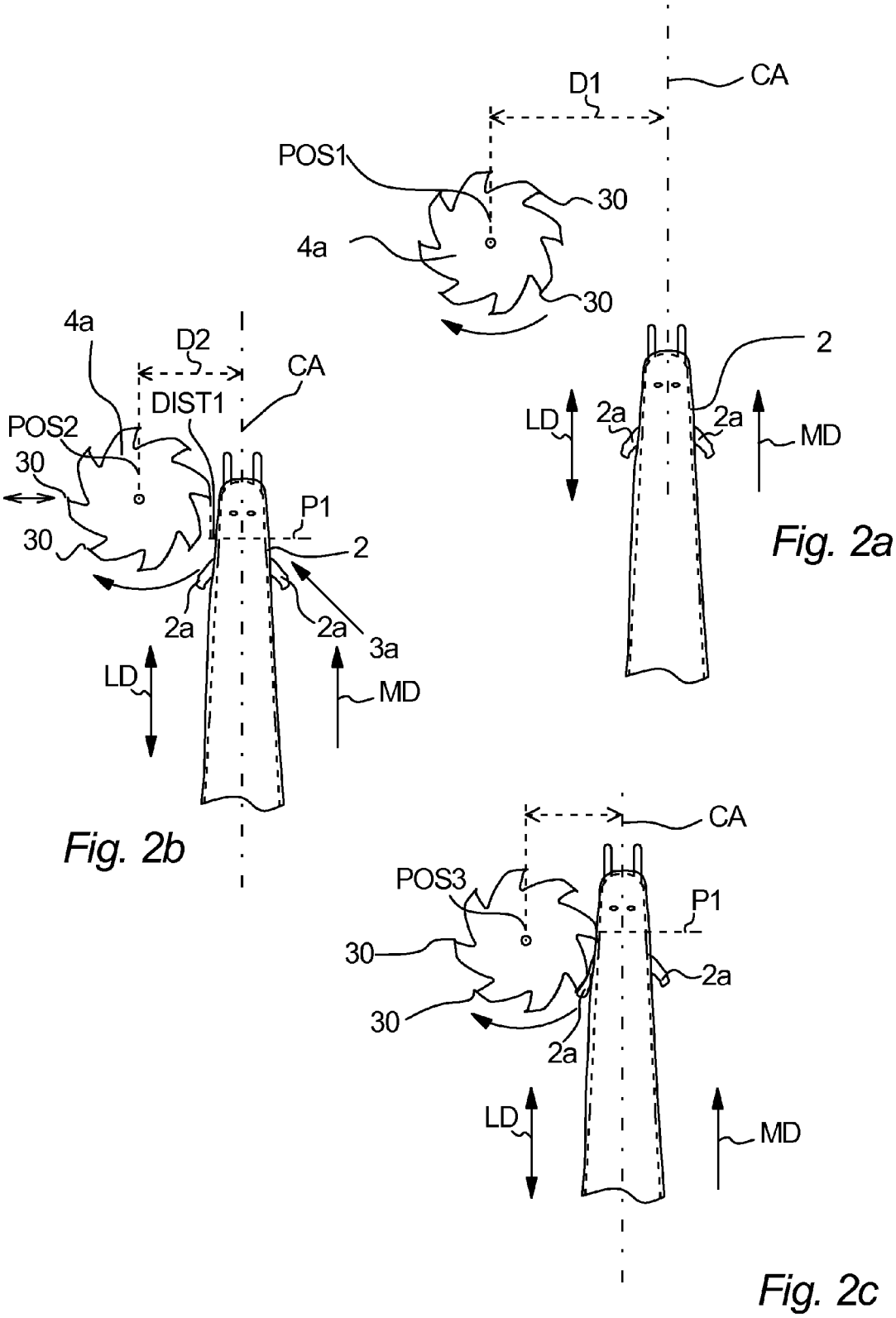
FIG. 2*a*-2*c*: illustrates an embodiment of arranging scraping means in different position in relation to a mandrel

FIGS. 2*a*-2*c* illustrates a way of arranging the scraping means of an apparatus 1. To ease the readability of FIGS. 2*a*-2*c*, only one scraping roller 4*a* of the first scraping unit 4 and the front end of the mandrel 3 is illustrated. However, it is understood that the same way arranging the scraping means 4*a* in different positions (POS1, POS2, POS3) as described in this document may be utilized for controlling the scraping means 4*a*, 4*b*, 5*a*, 5*b*, 8*a*, 9*a* of two or more scraping units 4, 5, 8, 9 e.g. as described in relation to e.g. FIG. 1.

Now, in FIG. 2*a*, the mandrel 3 is illustrated, where the fur 2 is to be scraped by the scraping roller 4*a*. Here the scraping means 4*a* are arranged away from the mandrel 3 in a first position POS1 with a first distance D1 to the center axis CA of the mandrel 3. The first position POS1 may e.g. be the position in which the scraping roller 4*a* may be arranged after the scraping of the skin side of a fur. After the scraping, the scraping means 4*a* may be pulled away from the surface of the mandrel e.g. to the indicated first position POS1 so as to avoid the scraping means getting in contact with the surface of the mandrel, and the mandrel 3 may be pulled back against the indicated movement direction so that a new fur 2 can be arranged on the mandrel 3.

Now, when or before the mandrel 3 is moved forwards in the longitudinal direction LD towards of the first part 3*a* of the mandrel 3 as indicated by the movement direction MD so as to scrape the skin side of the fur, the scraping roller 4*a* is arranged in its second position POS2.

At the second position POS2, the scraping roller 4*a* is arranged closer to the center axis CA of the mandrel 3 than in the first position POS1, but is still kept with a distance to the part of the mandrel 3 where the scraping means 4*a* is intended to start the scraping of the skin side. So the distance D1 from the scraping roller 4*a* to the center axis CA of the mandrel 3 in the first position POS1 is larger than the distance D2 from the scraping roller 4*a* to the center axis CA in the second position POS2.

Preferably the scraping means 4*a* is arranged to get in contact with the skin side at/near the neck region of the fur. Now, when the mandrel is in a predefined position P1 in relation to the scraping means 4*a*, the scraping means 4*a* is released towards the third position POS3 where the scraping means will be in contact with the fur 2 to scrape the skin side of the fur.

Hence, the apparatus may be adapted for detecting the movement of the mandrel in the movement direction MD so as to determine when to release the scraping means from the second position POS2 towards the third position during the movement of the mandrel 3. Thus, the scraping means may be released based on predetermined criteria such as e.g. the position of the mandrel during movement of the mandrel in the longitudinal direction LD.

The second position POS2 may e.g. be defined to be so that e.g. a scraper roller with the largest diameter that the apparatus is configured to operate with will be located with a small distance DIST1 from the skin side at the neck area of the fur when substantially opposite to the neck area as illustrated in FIG. 2*b*. For example with a distance of no more than 50 mm such as no more than 20 mm and preferably no more than 10 mm. For example the apparatus may be configured so that the scraping edges 30 of the largest scraper roller that a scraping unit of the apparatus is configured to operate with will be arranged with a distance of e.g. 3-10 mm such as e.g. 5 mm from the neck area of a fur on the mandrel when arranged substantially opposite to the neck area. Thus, when the scraping means are released from the second position POS2, the scraping edges 30 of the scraping means will quickly get in contact with the intended part of the skin side.

The overall distance from the first position POS1 to the third position may e.g. be about 150 mm such as 80 mm, e.g. about 55 mm. the distance from the second position POS2 to the third position POS3 may e.g. be about 50 mm such as 30 mm, e.g. 10 mm.

Figure 3:
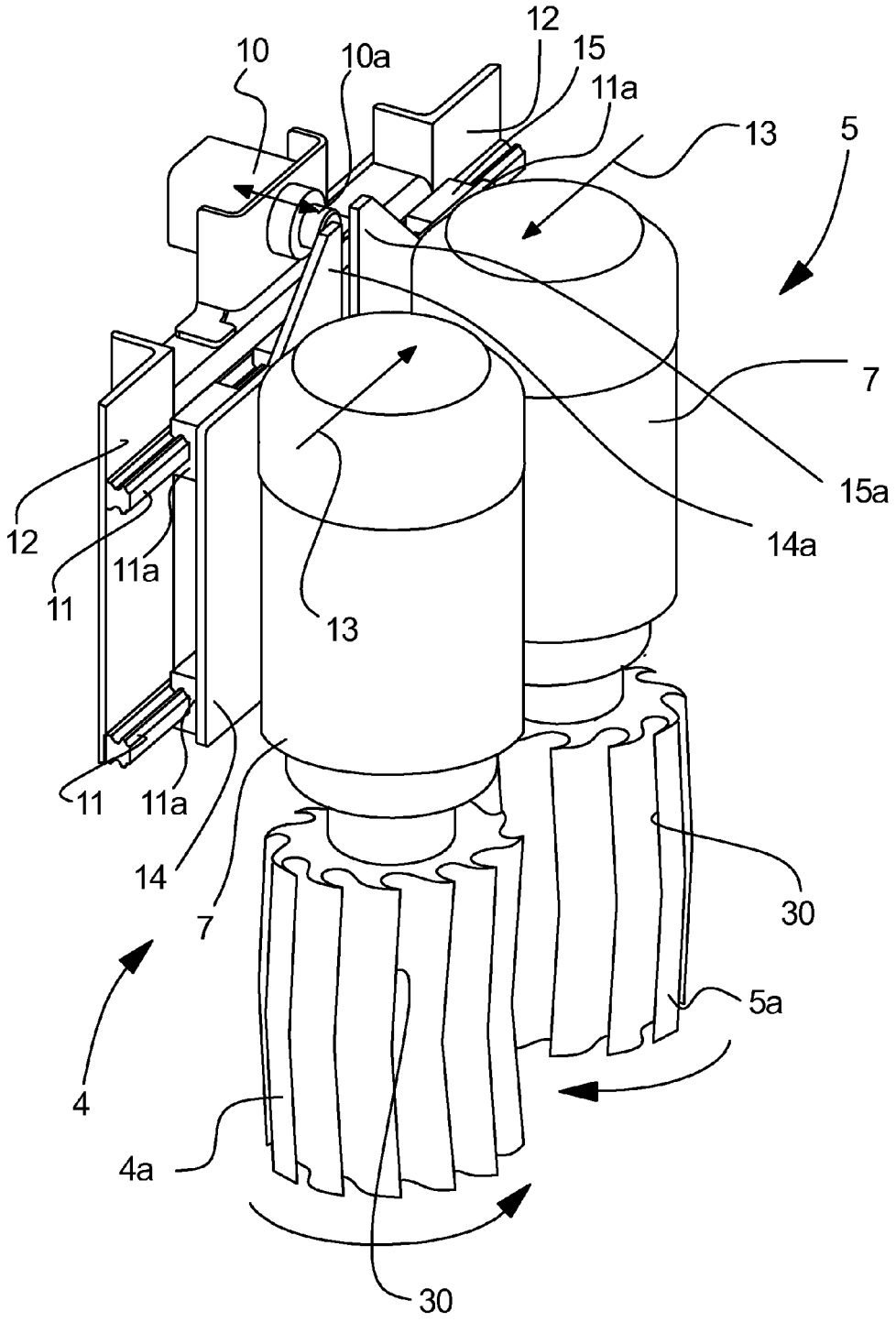
FIG. 3: illustrates an embodiment of a stop arrangement

FIG. 3 illustrates an embodiment of the apparatus comprising a stop arrangement 10. The stop arrangement 10 comprises a stop part 10*a* that may be arranged in two different stop part positions SPP1, SPP2 (See FIGS. 4*a*-4*b*). In the first stop part position SPP1, the stop part 11 is arranged so it retains the scraping means 4*a*, 5*a* of the scraping units 4, 5 (in embodiment comprising scraping means in the form of one scraping roller each) in the second position POS2. In the second stop part position (SPP2), the scraping means 4*a*, 5*a* are allowed to pass from the second position POS2 to the third position POS3 to scrape the skin side.

In the present example, the stop part 10*a* is in the second stop part position SPP2 so that the scraping means 4*a*, 5*a* are allowed to be moved towards the third position POS3. Thus, a pressure arrangement (not illustrated) may be able to press the scraping means 4*a*, 5*a* towards the mandrel 3 as indicated by the arrows 13. The mandrel is however not illustrated in FIG. 3 but as seen from e.g. FIG. 1 and/or other of the figures of the present document, the mandrel 3 may be moved in between the scraping means 4*a*, 5*b*.

In as described above, the movement of the scraping means between the first position POS1 and third position POS3 may be performed/achieved by means of a pressure arrangement (not illustrated). The pressure arrangement may e.g. comprise a linear actuator such as a pneumatic and/or hydraulic actuator. The scraping means may thus be retained in the second position by means of e.g. a stop arrangement as described in more details later on.

The movement towards and away from the mandrel 3 may be facilitated by means of a displacement arrangement for allowing the scraping means to be moved towards and away from mandrel. In the present example, the displacement arrangement comprises rails 11 on which the scraping units 4, 5 may slide in a direction towards and away from the mandrel, e.g. in a direction substantially perpendicular to the longitudinal direction of the mandrel 3. The rails 11 are thus fixed to a frame structure 12 of the apparatus, and the scraping units 4, 5 are, preferably by means of each their connection part 14, 15 connected to the rails 11 to slide on the rails by means of displacement parts 11*a*. So in the present example, the connection parts 14, 15 comprises the displacement parts 11*a* that may support on and slide along the rails 11 by being guided by the rails 11.

The connection parts 14, 15 may furthermore comprise a stop portion 14*a*, 15*a* that is configured being retained by the stop part 10*a* of the stop arrangement 10. Thus, when the stop part 10 a is arranged in the first stop part position SPP1, the stop part 10*a* will retain the scraping units and thus the scraping means 4*a*, 5*a* in the second position POS2 as described in relation to FIG. 2*a*-2*c*. When predefined criteria is compiled with, e.g. by a predefined position P1 on the mandrel being opposite to the scraping means, the stop part 10*a* is triggered and forced towards its second stop part position SPP2 to allow free passage for the scraping means 4*a*, 5*a* towards the mandrel 3 to the third position POS3.

The intended pressure force for pressing the scraping means towards the mandrel may in embodiments of the invention be applied already in the second position POS2 by the pressure arrangement. Thus, the stop part 10*a* may be designed to sustain this pressure force from the stop portions 14*a*, 15*a* to keep the scraping means 4*a*, 5*a* in the second position POS2 until the criteria are complied with.

In the present example, it is the same stop part 10*a* that releases both the scraping means 4*a* of the first scraping unit 4 and the scraping means 5*a* of the second scraping unit 5 which are arranged on opposite sides of the mandrel 3, towards the third position POS3. So in the present example, the stop part 10*a* is arranged to be displaced between the second stop part position SPP2 and the first stop part position SPP1 located between the stop portions 14*a*, 15*a*, this is described in more details in FIGS. 4*a* and 4*b*. This may e.g. be advantageous to reduce the space consumption, but may furthermore be advantageous in that substantially the same force is applied from opposite sides of the stop part 10*a*.

In other embodiments it is however understood that the scraping means 4*a*, 5*a* of the scraping units 4, 5 may be retained and controlled by each their individual stop arrangement 10.

The stop part 10*a* may be made of any suitable material that is able to sustain the pressure from the scraping units when the scraping units are arranged to be pressed towards the mandrel. For example, the stop part 10*a* may be made from e.g. a metal, a polymer material, a composite material and/or the like.

It is understood that even though the stop arrangement is described with reference to the first and second scraping units 4, 5 in FIG. 3, a substantially similar configuration may be implemented on one or more of the third scraping unit 8 and the fourth scraping unit.

Figure 4A:
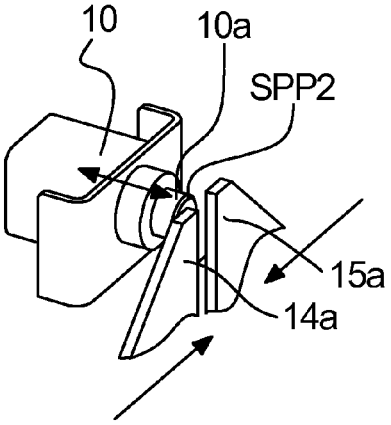
FIG. 4*a*-4*b*: illustrates embodiments of a stop arrangement with a stop part being arranged in different stop part positions, FIG. 5.: illustrates a flow chart relating to a way of arranging scraping means in different positions.

FIG. 4*a* illustrates a close-up view of the stop portions 14*a*, 15*a* (see FIG. 3) of the connection parts 14, 15 where the stop part 10*a* is arranged in the second stop part position SPP2 so that the scraping means are allowed to be moved to the third position POS3.

Figure 4B:
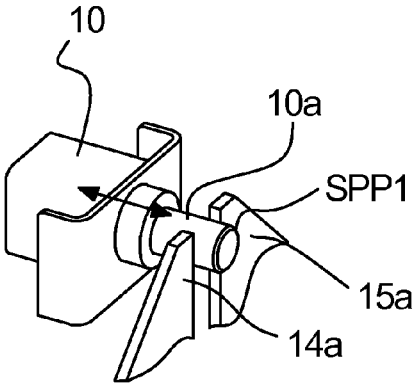

FIG. 4*b* illustrates a close-up view of the stop portions 14*a*, 15*a* of the connection parts 14, 15 where the stop part 10*a* is arranged in the first stop part position SPP1. Hence, as can be seen, the stop part 10*a* blocks the stop portions 14*a*, 15*a* so that the scraping means can be retained in the second position POS2.

As illustrated in FIGS. 3, 4*a* and 4*b*, the stop arrangement 10 may be arranged for retaining the scraping means 4*a*, 5*a* in the second position POS2 by a stop part 10*a* arranged for mechanically retaining the stop portions 14*a*, 15*a*. However, the scraping means may in other embodiments of the invention be arranged in the second position POS2 by any other suitable means. For example the stop arrangement may comprise a step motor, a toothed wheel arrangement and/or the like that may facilitate keeping control of the position of the scraping means/units. For example, by controlling such step motor/toothed wheels (and/or other means), it may be possible to arrange the scraping means 4*a*, 5*a* between the first, second and third positions POS1, POS2, POS3.

Also, in embodiments the stop arrangement comprises pneumatic means and may thus be triggered by pneumatics. However, it is understood that the stop arrangement may comprise any suitable means for moving the stop part between the different positions SSP1, SSP2. E.g. it may be electrically actuated, it may be a mechanic solution comprising a spring that is compressed in the first position and is released in the second position and/or the like.

Figure 5:
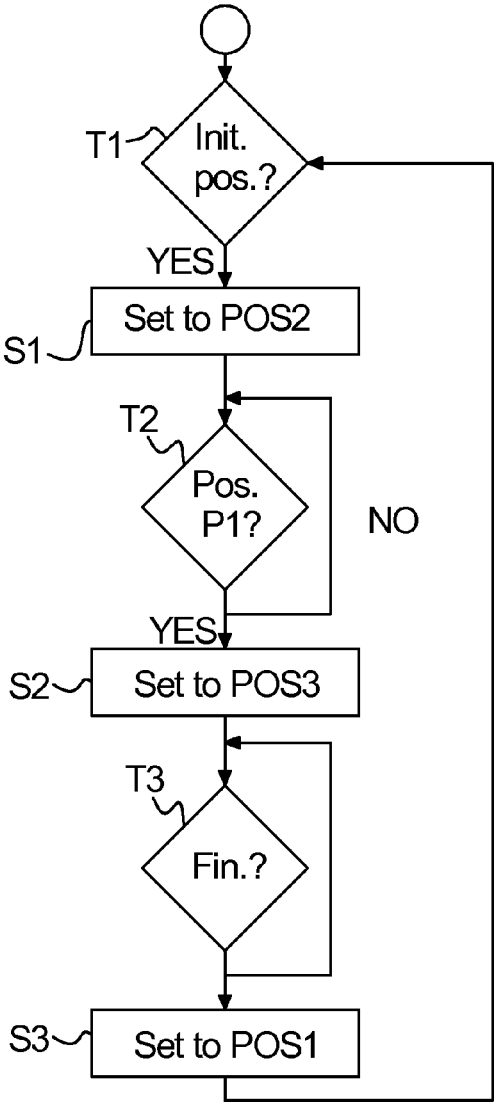

FIG. 5 illustrates a flow chart relating to an embodiment of a method of operating the apparatus between the first, second and third positions POS1, POS2, POS3.

In test T1, a control arrangement of the apparatus may test to see if the mandrel is pulled back or substantially pulled back to its initial position so that the scraping means can be arranged in the second position POS2. If it is, the scraping means of the scraping units is/are arranged in the second position POS2 in step S1.

During the relative movement between the scraping means and the mandrel in the longitudinal direction of the mandrel, the control means may in test T2 continuously monitor the position of the mandrel in relation to the scraping means. Thus, when a predetermined criteria is complied with, e.g. when a predetermined position P1 of the first part 3*a* of the mandrel is opposite to the scraping means, the scraping means are released from the second position POS2 to the third position POS3 to scrape the skin side (step S2). E.g. the mandrel 3 may then be moved in its longitudinal direction LD so as to that the skin side of the fur is scraped by means of the scraping means 4*a*, 5*a*, 8*a*, 9*a*.

When the scraping of the fur has finished (test T3), the scraping means are moved away from the mandrel to e.g. the first position POS1(Step S3) and the mandrel (and/or the scraping means) may be retracted to the starting position to allow a new fur to be arranged on the mandrel, and a new scraping process to start.

Figure 6:
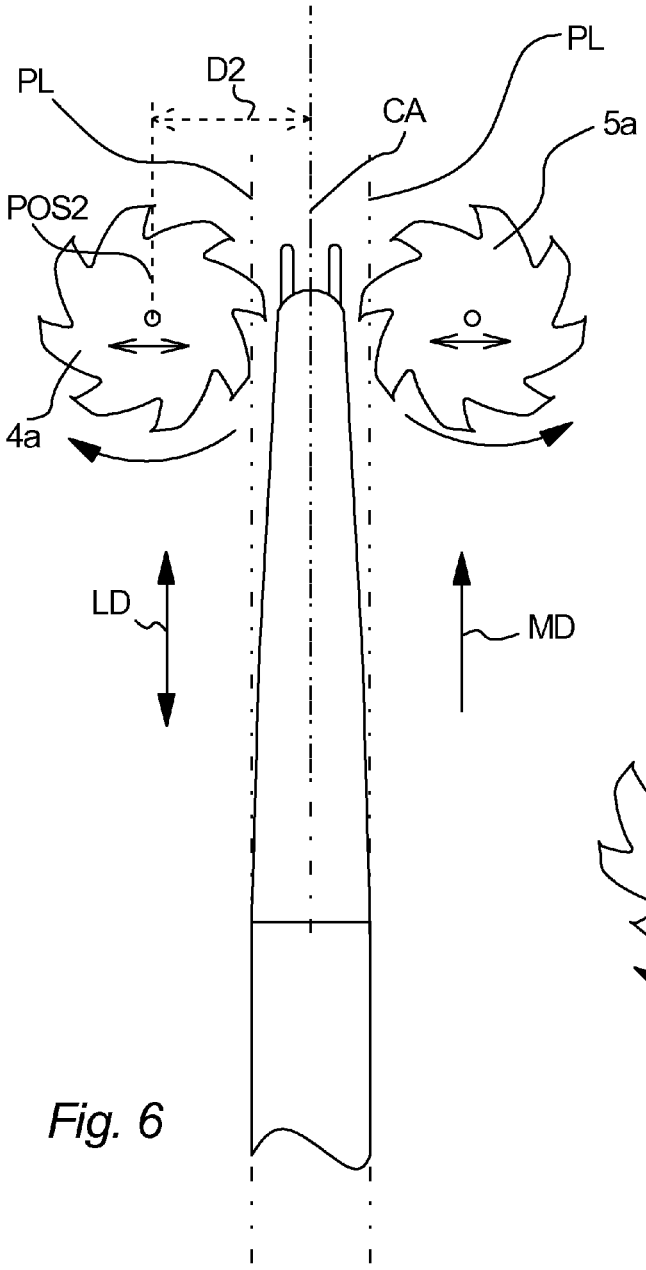
FIGS. 6-7: illustrates an embodiment of the invention where the edges of the scraping means are arranged between a center axis of the mandrel and a plane defined by the surface of the mandrel.

FIG. 6 illustrates an embodiment of the invention where the second position POS2 is located so that the scraping edges 30 of the scraping means 4*a*, 5*a* facing the skin side during rotation are arranged between the center axis CA of the mandrel and a plane PL. The plane PL is parallel to the longitudinal direction LD of the mandrel, and "touches" the outmost area of a surface (e.g. a side, top and/or bottom surface) of the mandrel 3. In FIG. 6, the plane PL is defined by surfaces of the mandrel being parallel to the center axis of the mandrel 3.

Figure 7:
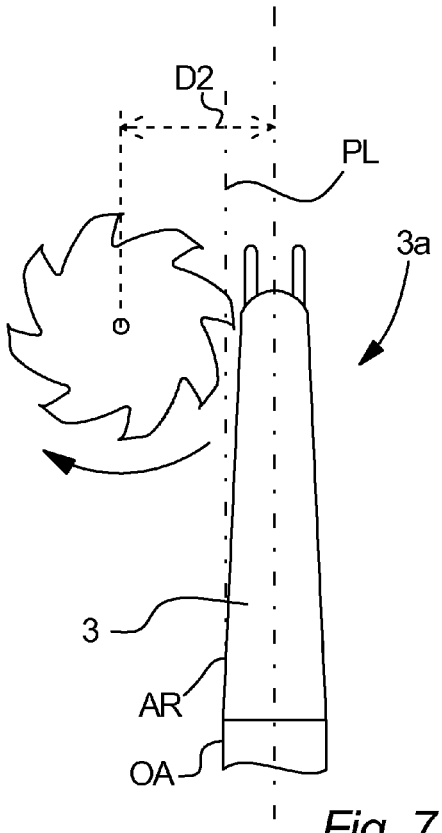

Alternatively, the plane PL may e.g. extend parallel to the center axis CA and from an area AR of a surface of the mandrel that is e.g. 1.5 meters from the front end of the mandrel 3, such as e.g. 1.0 meters from the front end of the mandrel, for example 0.7 meters from the front end of the mandrel 3 such as e.g. about 0.5 meters from the front end of the mandrel. This is illustrated in more details FIG. 7.

So in embodiments of the invention, the plane PL may extend parallel to the center axis CA of the mandrel 3 and may be arranged between the center axis CA and the outmost area/point OA of a side surface of the mandrel 3.

It is understood that in embodiments, the mandrel 3 may not comprise surfaces being parallel to the center axis, and in such an embodiment, where the mandrel may e.g. be formed as a cone with a surface curving around the center axis, the plane PL may e.g. extend parallel to the center axis CA and from a point between the front end and the rear end of the mandrel 3. For example 1.5 meters from the front end of the mandrel 3, such as e.g. 1.0 meters from the front end of the mandrel, for example 0.7 meters from the front end of the mandrel such as e.g. about 0.5 meters from the front end of the mandrel as described above.

Figure 8A:
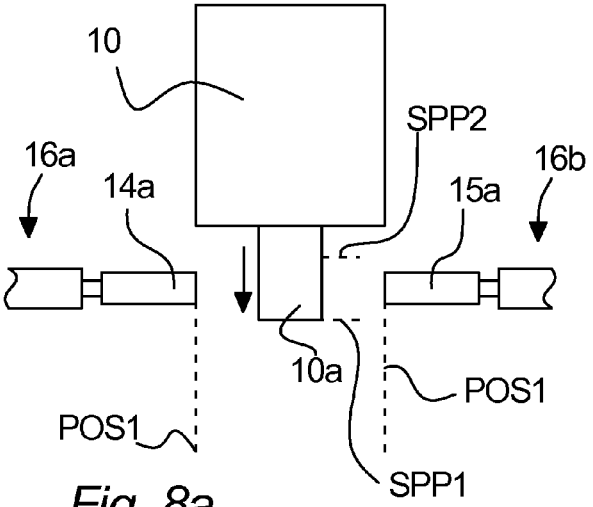
FIGS. 8*a*-8*c*: illustrates an example of the operation of a stop arrangement according to aspects of the invention.
Figure 8B:
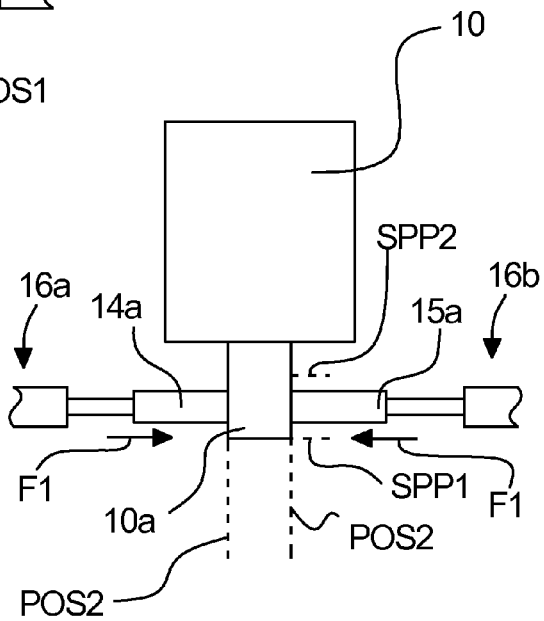
Figure 8C:
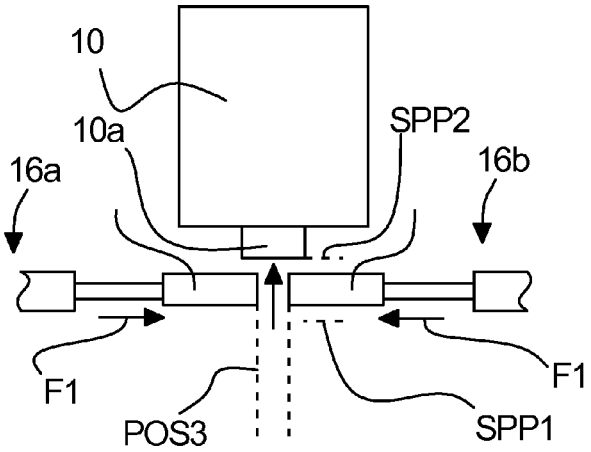

FIGS. 8*a*-8*c* illustrates a stop arrangement 10 in different positions in relation to stop portions 14*a*, 15*a* connected to each their scraping unit (not illustrated in FIG. 8*a*-8*c*), see e.g. FIGS. 3, 4*a* and 4*b*.

The stop arrangement 10 comprises in this embodiment a stop part 10*a* being configured for being arranged in different stop part positions SPP1, SPP2. In the present example, the stop part 10*a* may be arranged in a first stop part position SPP1 and a second stop part position SPP2. When arranged in the first stop part position SPP1, the stop part 10*a* will retain the scraping means in the second position POS2. When arranged in the second stop part position SPP2, the scraping means are allowed to pass from the second position POS2 to the third position POS3 to scrape the skin side of the fur.

In FIG. 8*a*, the stop part 10*a* is moved to the first stop part position SPP1. As illustrated, the stop portions 14*a*, 15*a* may be moved away from the stop part 10*a* to allow the stop part 10*a* to be arranged in the first stop part position POS1. The first position POS1 may e.g. be defined by and/or controlled by the pressure arrangement 16*a*, 16*b*.

In FIG. 8*b*, the stop part 10*a* retains the scraping means in the second position POS2 between the first position POS1 and the third position POS3. The stop part 10*a* in the present example retains the scraping means in the second position POS2. In an embodiment of the invention, the scraping unit(s) may be pressed towards the stop part 10*a* by means a pressure arrangement 16*a*, 16*b* as explained earlier, with the intended pressure force F1 that is to be utilized during the scraping of the skin side.

In FIG. 8*c*, the stop part 10*a* is moved towards the second stop part position SPP2. Hence, the scraping means are released from the second position POS2 due to the above mentioned pressure force F1 from the pressure arrangement 16*a*, 16*b*, and towards the mandrel.

In FIGS. 8*a*-8*c*, the pressure arrangement is illustrated as comprising a linear actuator in the form of e.g. a pneumatic and/or hydraulic actuator. It is however to be understood that the pressure arrangement 16*a*, 16*b* may comprise any suitable means facilitating moving the scraping means from the first position and towards the third position with an intended pressure force F1.

Figure 9A:
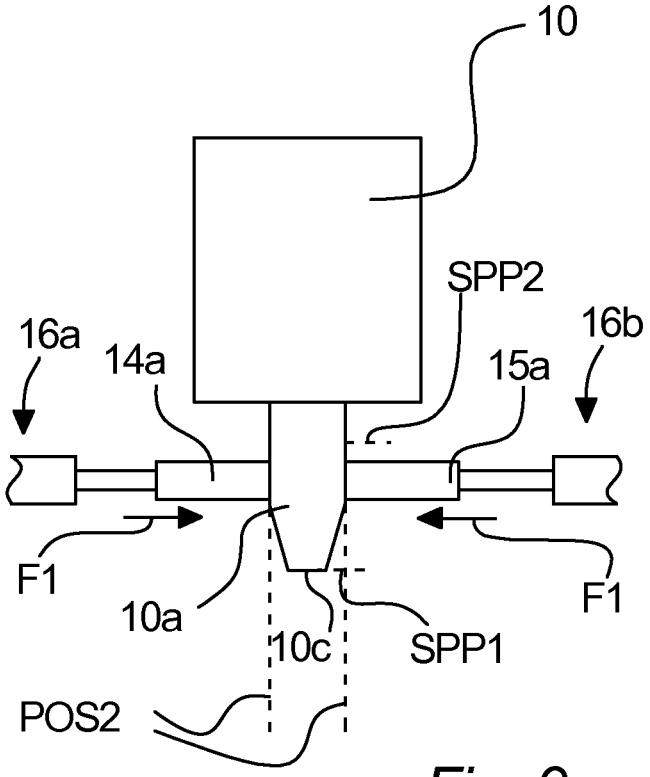
FIGS. 9*a*-9*b*: illustrates an embodiment of a stop arrangement comprising an inclining surface.
Figure 9B:
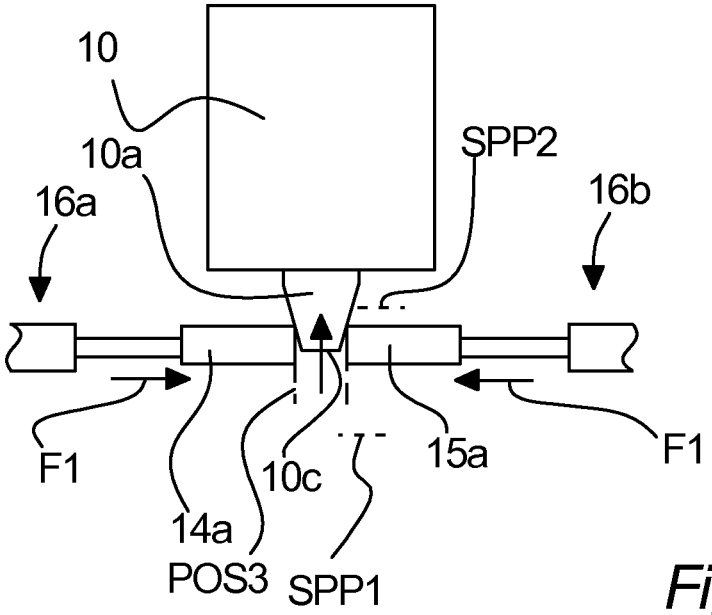

FIGS. 9*a*-9*b* in FIGS. 9*a* and 9*b*, the operation of the stop arrangement is substantially similar to the operation as described in relation to FIGS. 8*a*-8*c*. However, in FIGS. 9*a*-9*b*, the stop part 10*a* comprises one or more surfaces inclining towards the end part 19*c* of the stop part 10*a*. This may in embodiments e.g. result in a stop part with an end 10*c* having a conical shape. Thus, when the stop part 10*a* is moved from the first stop part position SPP1 to the second stop part position SPP2, the inclining surface(s) guides the scraping means/scraping unit towards the third position POS3. This may e.g. help to assure that the scraping means gets in contact with the skin side in a more controlled way.

In embodiments of the invention the movement between said mandrel and said scraping means in the longitudinal direction of said mandrel may comprise different predefined speeds (V1, V2) in the longitudinal direction (LD) of said mandrel. Such predefined speeds may comprise a first speed (V1) and a second predefined speed (V2), where the second predefined speed (V2) is higher than said first predefined speed (V1). In such embodiments, the mandrel (and/or said scraping means) may be arranged for being moved with the first speed (V1) in the longitudinal direction of the mandrel at least until said scraping means (4*a*, 5*a*, 8*a*, 9*a*) is in contact the said skin side. The mandrel (and/or the scraping means) may furthermore be are arranged for being moved with the second speed (V2) when said scraping means are in contact with the skin side. This is however not illustrated in any figures.

Also, in embodiments of the invention, the apparatus may comprise a damper arrangement arranged for damping the movement of the scraper devices towards and/or away from the mandrel while the mandrel 3 moved in the longitudinal direction LD and the scraping edges of the scraping means are arranged to be in contact with the skin surface of the fur 2 to scrape the skin side. The damping arrangement (not illustrated) may comprise one or more damping means such as e.g. hydraulic and/or pneumatic damping means (e.g. shock absorbers) arranged so as to damp the movement of the scraping means towards and/or away from the mandrel while the mandrel 3 is moved in the longitudinal direction.

Figure 10A:
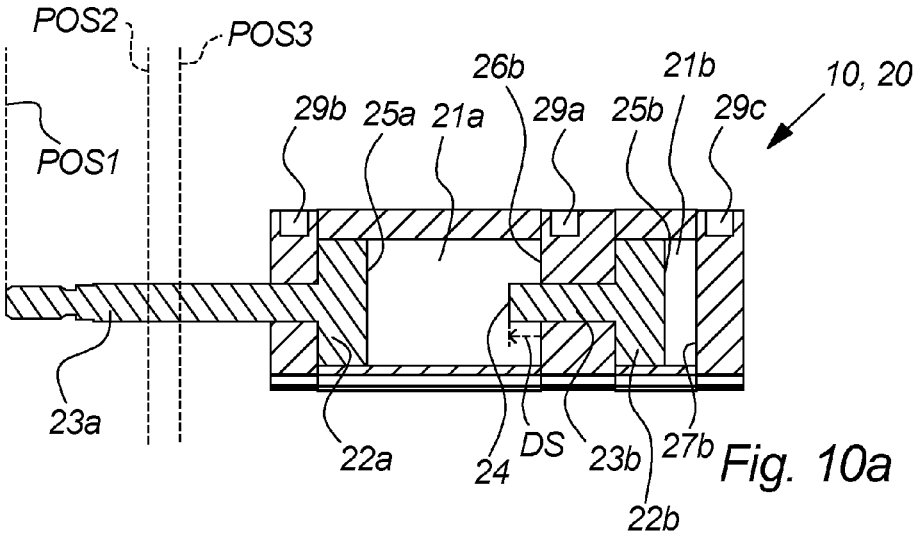
FIGS. 10*a*-10*c*: illustrates a further embodiment of a stop arrangement.
Figure 10B:
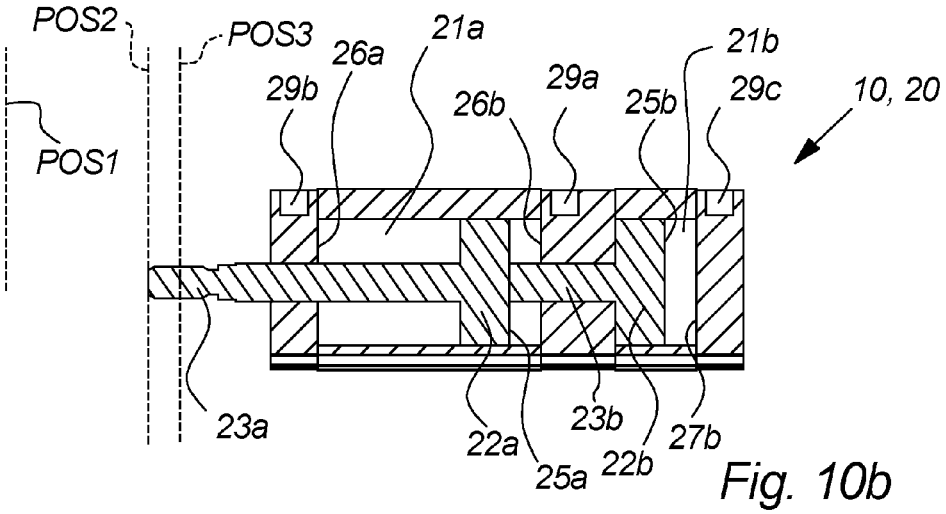
Figure 10C:
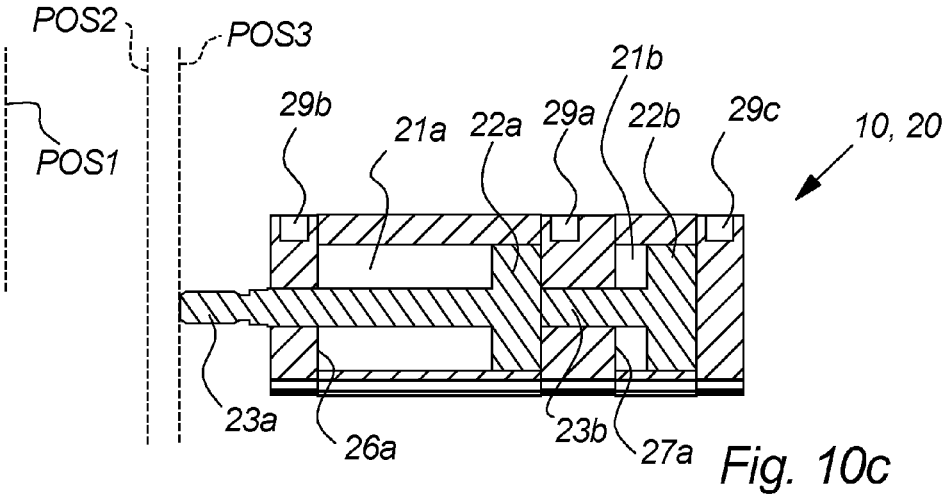

FIG. 10*a*-10*c* illustrates another embodiment of a stop arrangement 10 comprising a space-saving multiple-position cylinder arrangement 20 (also referred to as "cylinder arrangement" in the following) according to embodiments of the invention.

The cylinder arrangement 20 comprises two independent cylinder chambers in the form of a first chamber 21*a*, and a second chamber 21*b*. A first piston 22*a* is connected to a first piston rod 23*a* and is arranged to be moved inside the first chamber 21*a*. The second piston 22*b* is connected to a second piston rod 23*b* and is arranged to be moved inside the second chamber 21*b*. The second piston rod 23*b* may extend into the first chamber 21*a* and comprises an end surface 24. The second piston rod 23*b* may also be referred to as a stop part.

The scraping means (not illustrated in FIGS. 10*a*-10*c*) as described in more details above is connected to the first piston rod 23*a*. The different positions POS1, POS2 and POS3 are indicated in FIGS. 10*a*-10*c* by the vertical dashed lines. It is understood that the positions in FIGS. 10*a*-10*c* are only illustrative to describe the position of the piston rod in the different predefined positions POS1-POS3 of the scraping means as described above.

In the first "initial" position POS1, the first piston rod 23*a* is arranged in a first outmost position and is retained in this first position by a first inner end wall 26*a* of the first chamber. The first 22*a* piston and thus the first piston rod 23*a* is forced into this position by means of a pressurized fluid such as pressurized air entering a first fluid inlet 29*a* arranged between a second 29*b* fluid inlet and a third 29*c* fluid inlet. Additionally, the second piston 22*b* is arranged in an initial position where the piston rod extends into the first chamber as illustrated in FIG. 10*a* by means of a pressure applied to the fluid inlet 29*c*. The second piston is retained by the surface 27*a* of the wall separating the first and second chamber. This position is illustrated in FIG. 10*a*.

The scraping means are moved into the second position POS2 by removing the pressure at the first fluid inlet 29*a* and applying a pressure to a second fluid inlet 29*b*. This pressurized air rapidly moves the piston 22*a* towards the other end of the first chamber 21*a*, but here it is retained in the second position POS2 by the end surface 24 of the second piston rod 23*b* which extends into the first chamber when the surface 25*a* of the first piston 22*a* reaches the surface 24 of the second piston rod 23*b*. The second piston rod hence prevents the first piston 22*a* from being moved the last remaining distance towards the second end wall 26*b* of the first chamber 21*a*. The second piston rod 23*b* is retained in the position that results in that the first piston rod is retained in the second position POS2 by means of pressurized fluid such as pressurized air entering the second chamber from a third fluid inlet 29*c*. Thereby, the second piston 22*b* is pressed towards a first end wall 27*a* of the second chamber 21*b*. The first end wall 27*b* of the second chamber is a part of the wall structure separating the first chamber and the second chamber. This is illustrated in FIG. 10*b*.

The pressure applied to the third fluid inlet 29*c* is either equal to or higher than the pressure applied to the second fluid inlet 29*b* when the second piston is to be arranged in the position as illustrated in FIGS. 10*a* and 10*b*.

When the scraping means are moved into the third position POS3, the pressure at the third fluid inlet 29*c* is removed which results in that the first piston is allowed to move the last distance towards the second end wall 26*b*. The first piston hence presses the second piston 22*b* towards the second end wall 27*b* of the second chamber 21*b* so that the surface 25*b* of the second piston 22*b* touches the second end wall 27*b*. This is illustrated in FIG. 10*c*.

When the second piston 22*b* is arranged in the in the position as illustrated in FIGS. 10*a* and 10*b*, the distance DS between the end surface 24 of the second piston rod 23*b* and the second end wall 26*b* of the first chamber 21*a* substantially corresponds to the distance that the scraping means is/are travels when moving from the second intermediate position POS2 to the third position POS3.

It is noted that it is the pressure at the fluid inlet 29*b* that may determine the scraping pressure that the scraping means applies to the skin side. Thus, by adjusting the fluid pressure applied at the inlet 29*b*, the scraping pressure is adjusted.

The cylinder comprising the first piston 22*a* is considered as a double acting cylinder whereas the cylinder comprising the second piston 22*b* is considered as a single acting cylinder.

When the pistons 22*a*, 22*b* are to be moved into their initial position as illustrated in FIG. 10*a*, the pressure at the second fluid inlet 29*b* is removed and a pressure is applied to the first 29*a* and third 29*c* fluid inlets respectively until a scraping of a new skin is initiated.

The overall length of stroke of the cylinder arrangement 20 may e.g. be about 150 mm such as 80 mm, e.g. about 55 mm. the distance from the second position POS2 to the third position POS3 may e.g. be about 50 mm such as 30 mm, e.g. 10 mm. As an example, the stroke from the first position POS1 to the second position POS2 may e.g. be about 45 mm and the stroke from the second position POS2 to the third position POS3 may be about 10 mm, hence resulting in a 55 mm overall length of stroke of the cylinder arrangement 20.

In aspects of the invention, the mandrel 3 may be driven in its longitudinal direction with different predetermined speeds, e.g. dependent on the type of skin, the scraping pressure acting on the skin side, dependent on the race of the furred animal from which the skin originates and/or the like. The speed of propulsion of the mandrel may in such aspects e.g. be dependent on different settings in a computer program configured for controlling the propulsion speed of the mandrel. In such aspects, a computer program controlling at least a part of said apparatus may be adapted to control the release of the scraping means from the second position POS2 towards the third position POS3 dependent on the speed of propulsion of the mandrel 3 in the mandrel's longitudinal direction. If for example the mandrel 3 is driven with a high speed, the scraping means should be released from the second position towards POS2 the mandrel earlier compared to if the mandrel was driven with a lower speed so as to compensate for the time delay from releasing the scraping means until they are in contact with the mandrel/skin side. So hence, the time for releasing the mandrel from the second position may be arranged to vary automatically dependent of the speed of propulsion of the mandrel. This may e.g. facilitate that the scraping means gets in contact with a skin on the mandrel at substantially the same location no matter the speed of the mandrel.

It is to be understood that the apparatus may generally comprise control means/arrangement(s) such as one or more central processing units, data storages, computer program codes and/or the like which together are adapted to operate the apparatus according to one or more of the above disclosed aspects and embodiments.

For example the apparatus may comprise control means such as e.g.

one or more central processing units (CPU), data storage(s), data input arrangements for the control means for receiving input from sensors, a user interface and/or the like, data output arrangements for providing outputs to different parts of the apparatus such as movable parts of the apparatus (e.g. motors, actuators, frequency converter (s)

etc.

so as to facilitate that a computer program product can operate the apparatus according to the various embodiments/aspects disclosed in this document.

In general, it is to be understood that the invention is not limited to the particular examples described above but may be adapted in a multitude of varieties within the scope of the invention as specified in the claims. For example, in embodiments of the invention, the apparatus may comprise a mandrel being arranged to rotate around its center axis, and one or more scraping units comprising scraping means may e.g. be arranged to be moved in the longitudinal direction of the mandrel to scrape the skin side of a fur arranged on the mandrel while the mandrel rotates. Such embodiments are however not illustrated in this document.

Also, it is understood that the scraping units may comprise any suitable type of scraping means such as e.g. scraping rollers as illustrated arranged for being rotated around a rotation axis that may be substantially parallel to one or more surfaces of the mandrel. Also, the scraping means may in embodiments comprise scraping devices comprising scraping edges and being arranged for being rotated around an axis that may be substantially perpendicular to a surface of the mandrel to be scraped by the scraping device.

Furthermore, it is to be understood that two or more embodiments and/or features illustrated in one or more figures may also be combined in a multitude of varieties to achieve different embodiments not directly described in this document. For example, the shifting between one or more predetermined speeds dependent of the location of the mandrel in relation to the scraping means, and/or the implementation of a damping arrangement as described above may e.g. be implemented in any of the described embodiments of the present document such as e.g. embodiments described in relation to one or more of the FIGS. 1-9*b* of the present document.

The invention claimed is:

1. An apparatus for processing the skin side of a tubular fur, which apparatus comprises:

a tapering mandrel comprising a first part that is thinner than a second part of the mandrel, on which mandrel the tubular fur can be drawn from the first part of the mandrel towards the second part of the mandrel so that the skin side of the fur faces outwards and the fur side of the fur faces inwards towards the mandrel, and one or more scraping units, each scraping unit comprising one or more scraping means for scraping said skin side, said one or more scraping units being configured for being moved towards and away from said mandrel during operation of said apparatus, said apparatus being configured for providing a movement between said mandrel and said one or more scraping means in the longitudinal direction of said mandrel during operation, wherein said one or more scraping means are configured for being arranged in a first position away from said mandrel with a first distance in relation to the centre axis of said mandrel, and in a third position where the scraping means are configured for being in contact with said skin side so as to process the skin side of said fur, wherein said one or more scraping means are furthermore configured for being arranged in a second predefined position, said second predefined position being arranged between said first position and said third position with a second predefined distance in relation to the centre axis of said mandrel, and wherein said apparatus is configured for automatically releasing said scraping means from said second position towards said third position when predetermined criteria is complied with.

2. An apparatus according to claim 1, wherein said predetermined criteria comprises that the apparatus is configured for detecting the position of the mandrel in relation to said scraping means during said movement in the longitudinal direction, and wherein said apparatus is configured for releasing said one or more scraping means from the second position towards the mandrel when the mandrel and/or said one or more scraping means is/are in a predetermined position during said movement.

3. An apparatus according to claim 1, wherein said scraping means are configured for being released from said second position towards said third position when said one or more scraping means are opposite to a predetermined position on said mandrel.

4. An apparatus according to claim 1, wherein said scraping means are at least one scraper roller, and wherein said second position is located so that scraping edges of said at least one scraper roller facing the skin side during rotation are arranged between the centre axis of the mandrel and a plane defined by a part of the surface of said mandrel and being substantially parallel to said centre axis of said mandrel.

5. An apparatus according to claim 1, wherein said scraping means are arranged to be retained in said second position by means of a stop arrangement, and wherein said apparatus is configured for automatically triggering said stop arrangement when said predetermined criteria is complied with so as to allow movement of said scraping means from said second position towards said mandrel to said third position.

6. An apparatus according to claim 1, wherein said apparatus comprises a stop part being configured for being moved between a first stop part position where it is arranged for retaining said one or more scraping means in said second position, and a second stop part position where the said one or more scraping means are allowed to pass from said second position towards said third position.

7. An apparatus according to claim 1, wherein said movement between said mandrel and said one or more scraping means in the longitudinal direction of said mandrel comprises different predefined speeds in the longitudinal direction of said mandrel, said predefined speeds comprising a first speed and a second predefined speed, said second predefined speed being higher than said first predefined speed.

8. An apparatus according to claim 7, wherein said mandrel and/or said one or more scraping means are arranged for being moved with said first speed in the longitudinal direction of the mandrel at least until said one or more scraping means is in contact with said skin side, and wherein said mandrel and/or said one or more scraping means are arranged for being moved with said second speed when said one or more scraping means are in contact with said skin side.

9. An apparatus according to claim 1, wherein said movement between said mandrel and said one or more scraping means in the longitudinal direction of said mandrel comprises that said mandrel is configured for being moved in its longitudinal direction.

10. An apparatus according to claim 1, wherein said apparatus comprises at least one set of scraping units comprising scraping means arranged on opposite sides of said mandrel.

11. An apparatus according to claim 10, wherein said one or more scraping means arranged on opposite sides of said mandrel are arranged for being released from said second position to said third position by means of the same stop arrangement.

12. An apparatus according to claim 1, wherein said apparatus comprises a damper arrangement arranged for damping the movement of said at least one scraping means towards and/or away from the mandrel during scraping of the skin surface by means of the at least one scraping means.

13. An apparatus according to claim 1, wherein a release of said one or more scraping means from said second position to said third position is configured to be dependent on the speed of propulsion of said mandrel so that said one or more scraping means are released from said second position to said third position when the mandrel is in different positions in relation to the scraping means dependent on the speed of propulsion of said mandrel.

14. An apparatus according to claim 1, wherein said one or more scraping means comprises a scraping roller with a plurality of scraping edges, said scraper roller being arranged to be rotated to scrape the skin side of said fur during operation of said apparatus.

15. A method of operating one or more scraping means of an apparatus according to claim 1, wherein said one or more scraping means are arranged:

in a first position away from a mandrel of said apparatus with a first distance in relation to the centre axis of said mandrel, a third position where the scraping means are arranged to be in contact with said skin side so as to process the skin side of said fur, and a second position, said second position being arranged between said first position and said third second position with a second predefined distance in relation to the centre axis of said mandrel, wherein said one or more scraping means are moved from said second position towards said mandrel to said third position when said predetermined criteria are complied with.

16. A method according to claim 15, wherein said one or more scraping means comprises a scraping roller with a plurality of scraping edges, said scraper roller being arranged to be rotated to scrape the skin side of said fur during operation of said apparatus.

17. A method according to claim 15, wherein said mandrel is driven in it's longitudinal direction with different speeds, wherein a release of said one or more scraping means from said second position to said third position is dependent on the speed of propulsion of said mandrel so that said one or more scraping means are released from said second position to said third position when the mandrel is in different positions in relation to the scraping means dependent on the speed of propulsion of said mandrel.

18. A computer program product which, when implemented on a control arrangement for an apparatus for processing fur, is configured for operating said apparatus in accordance with claim 1.

19. A computer program product which, when implemented on a control arrangement for an apparatus for processing fur, is configured for operating said apparatus in accordance with claim 15.

* * * * *